United States Patent [19]

Hagemeyer

[11] Patent Number: 5,067,279

[45] Date of Patent: Nov. 26, 1991

[54] SELF DRAINING DOOR THRESHOLD

[75] Inventor: Bruce A. Hagemeyer, Pella, Iowa

[73] Assignee: Rolscreen Company, Pella, Iowa

[21] Appl. No.: 650,225

[22] Filed: Feb. 4, 1991

[51] Int. Cl.[5] ..... E06B 1/70

[52] U.S. Cl. ..... 49/471; 49/470

[58] Field of Search ..... 49/471, 469, 470, 408; 52/209, 198

[56] References Cited

U.S. PATENT DOCUMENTS

| | | | |
|---|---|---|---|
| 96,233 | 10/1869 | Hemberger | 49/471 X |
| 299,089 | 5/1884 | Reynolds . | |
| 1,795,853 | 3/1931 | Glass | 49/471 X |
| 2,010,609 | 7/1934 | Shogren | 20/64 |
| 2,108,137 | 4/1936 | Oftedal et al. | 20/64 |
| 3,314,201 | 4/1967 | Riegelman | 52/209 |
| 3,410,027 | 11/1968 | Bates | 49/471 |
| 3,849,938 | 11/1974 | Thompson | 49/471 |
| 3,851,420 | 12/1974 | Tibbetts | 49/471 |
| 4,055,917 | 11/1977 | Coller | 49/469 |
| 4,229,905 | 10/1980 | Rush | 49/143 |
| 4,310,991 | 1/1982 | Seely | 49/471 X |
| 4,686,793 | 8/1987 | Mills | 49/471 |
| 4,831,779 | 5/1989 | Kehrli et al. | 49/471 |
| 4,999,950 | 3/1991 | Beske et al. | 49/471 X |

*Primary Examiner*—Philip C. Kannan

*Attorney, Agent, or Firm*—Zarley, McKee, Thomte, Voorhees & Sease

[57] ABSTRACT

A self draining door threshold includes a wedge-shaped silicone check valve in communication with a water reservoir on the interior side. The check valve is normally closed but will yieldably open in response to water pressure which overcomes the resilience of the silicone material and the air pressure on the top wall of the wege-shaped passageway. The check valve functions as a seal against incoming air but will open to allow escape of water as needed. The silicone material seals around foreign material in the valve making it air tight. The bottom edge of the door includes moisture resistant material having an upwardly extending portion received in a groove. The exterior side of the door is also covered with moisture resistant material which has inwardly extending portions received in a vertical groove between abutting panels. A moisture resistant plate extends along the bottom edge of the door and has downwardly extending portions engaging the weather seal on the threshold on the exterior side and a wood portion of the threshold on the interior side. The plate directs water from the vertical groove outwardly of the door.

26 Claims, 2 Drawing Sheets

SELF DRAINING DOOR THRESHOLD

BACKGROUND OF THE INVENTION

Water leakage at door thresholds is a problem particularly on in-swinging doors. Improvements in weatherstripping have occurred, but the problem still remains An objective of a self draining threshold is to permit the water that gets past the weatherstripping to be diverted back outside without allowing air leakage to the interior.

SUMMARY OF THE INVENTION

The self draining threshold of this invention diverts water which gets past the weatherstripping between the threshold and the door back outside without allowing exterior air to get inside. This is accomplished through the use of a check valve between a reservoir of water on the inside and the exterior. The check valve is normally closed but when water pressure exceeds exterior air pressure on the back side of the valve, the valve will open allowing the water to exit and at the same time sealing the passageway against incoming exterior air. The check valve includes a passageway that converges from the interior inlet end to the exterior outlet end and has an exposed flexible wall which is responsive to the exterior air pressure which tends to close the outlet end of the passageway.

The threshold includes a sill having an interior section and an exterior section both of which have removable top walls for giving access to the interiors for cleaning and servicing.

The door is sealed with weatherstripping on the threshold which engages a downwardly extending plate on the bottom edge of the door. The plate seals the wood surface on the bottom edge against moisture. The exterior side of the door includes a moisture resistant material having an inwardly extending portion along the bottom edge of the door which in turn has an upwardly extending portion received in a groove in the bottom edge for sealing the door against moisture If the wood door has panels, the moisture resistant material on the exterior surface includes inturned portions received in a vertical groove between the abutting panels. Moisture that enters the vertical groove will run to the bottom edge of the door and be directed outwardly away from the door by the plate on the bottom door edge.

DESCRIPTION OF THE PREFERRED EMBODIMENT

Figure 2:
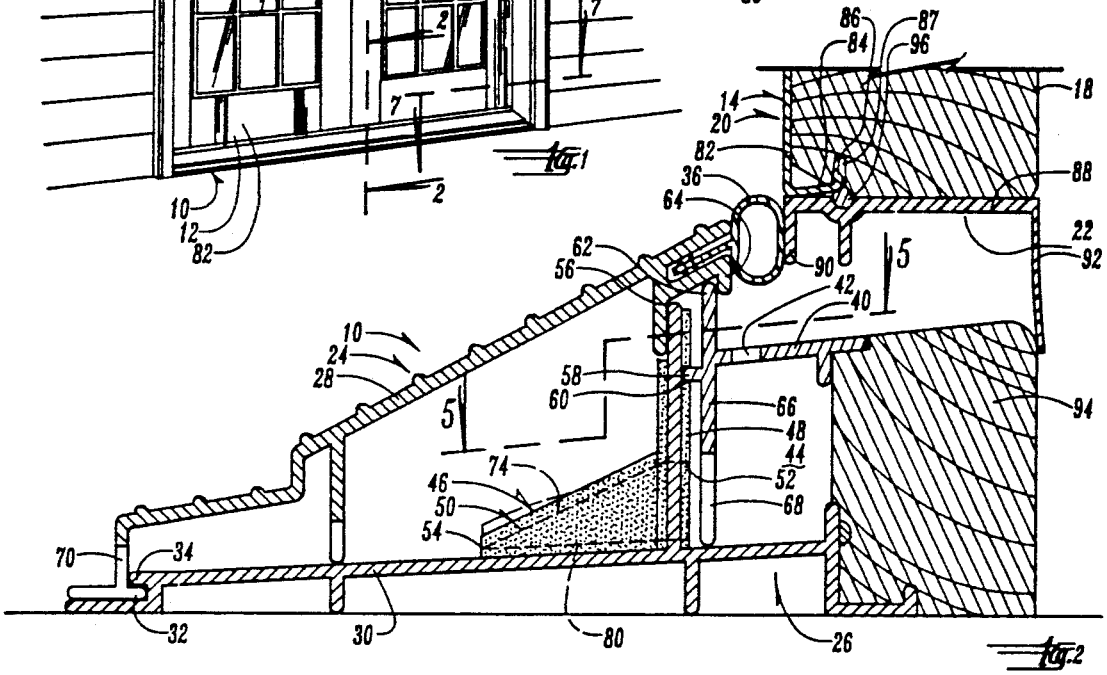
FIG. 2 is a cross-sectional view taken along line 2—2 in FIG. 1.

The self draining threshold of this invention is referred to generally in FIG. 2 by the reference numeral 10 and is shown incorporated into a pair of french doors 12 and 14 having a frame 16. The door 14 has an interior side 18 and an exterior side 20 and a bottom edge 22.

The self draining threshold 10 includes an exterior section 24 and an interior section 26. The exterior section 24 includes an aluminum sill or cover 28 over an aluminum sill support 30. Overlapping shoulders 32 and 34 interlock the support 30 to the cover 28. A weatherseal 36 is provided on the interior facing edge of the cover 28. The interior section 26 includes a polypropylene sill insert removable cover 40 which has a drain hole 42 in communication with a reservoir 44.

Figure 3:
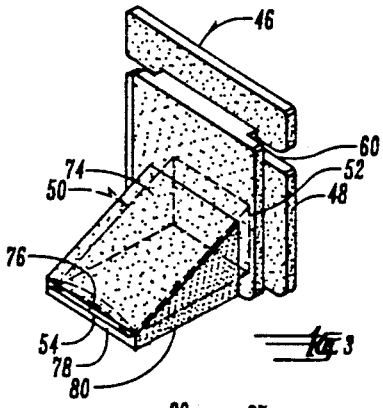
FIG. 3 is a perspective view of the valve.

A silicone check valve 46 is seen in FIG. 3 and is seen positioned in the exterior section 24 in FIG. 2. The check valve 46 includes a vertically disposed frame member 48 to which a wedge-shaped silicone passageway 50 is connected. The passageway 50 includes an inlet end 52 and an outlet end 54. The passageway converges from the inlet end to the outlet end.

A downwardly extending flange 56 on the cover sill 28 engages the upper end of the frame member 48 to hold the check valve 46 in place. The polypropylene sill insert cover 40 includes a horizontally extending shoulder 58 received in slot 60 in the frame member 48. An upstanding flange 62 engages a downwardly extending shoulder 64 on the sill 28. The sill insert cover 40 also includes a downwardly extending member 66 which engages the sill support 30 and includes a drain opening 68 in communication with the inlet end 52 of the check valve 46.

Figure 4:
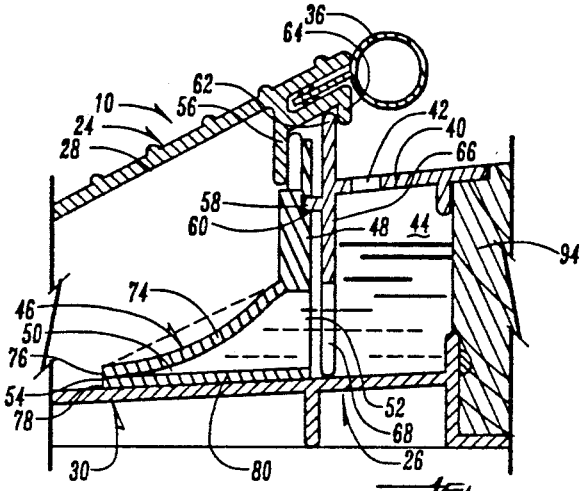
FIG. 4 is a fragmentary view similar to FIG. 2 but showing the check valve in a closed position in response to exterior air pressure which exceeds interior water pressure within the valve and connected reservoir.
Figure 5:
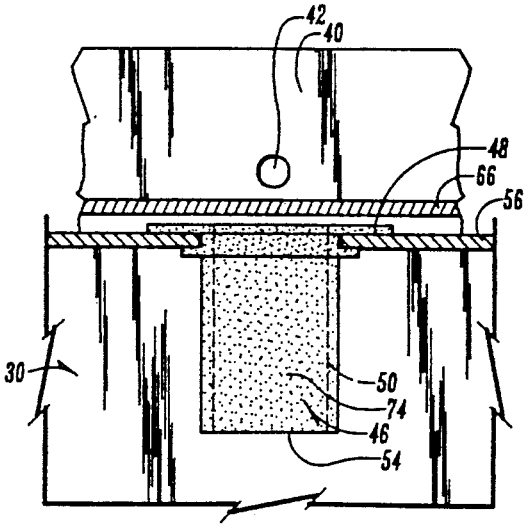
FIG. 5 is a cross-sectional view taken along line 5—5 in FIG. 2.
Figure 6:
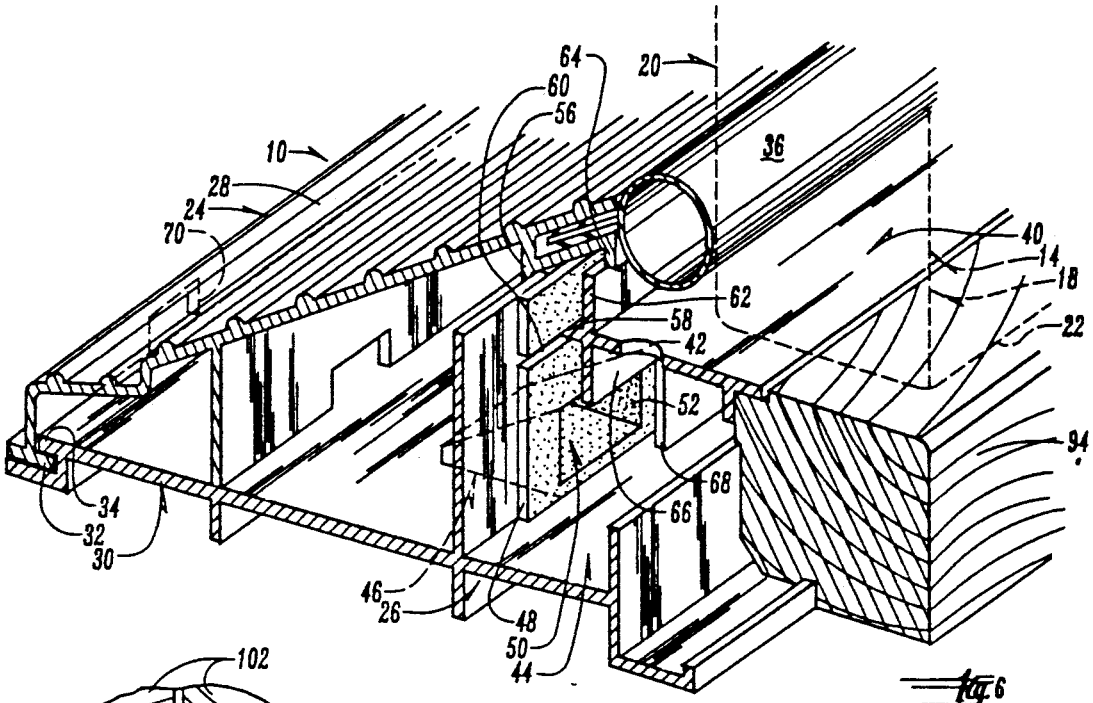
FIG. 6 is a fragmentary perspective view similar to that of FIG. 2.

It is thus seen that water that is able to get between the weatherstripping 36 and the door 14 is received in the reservoir 44 and flows through the opening 68 of the sill insert cover 40 into the inlet end 52 of the check valve 46. Water passing through the check valve will exit through opening 70 in the aluminum sill cover 28. The silicone material of the check valve 46 is flexible and will yield to water pressure inside to move to the dash line position shown in FIG. 2 thereby opening the outlet end 54. Air pressure within the exterior section 24 will impact upon the converging sloped top wall 74 and deflect it inwardly as seen in FIG. 4 sealing off the outlet end 54. When the water pressure due to the water in the reservoir 44 and the check valve 46 exceeds the exterior air pressure in the exterior section 24, the outlet end 54 will open allowing escape of the water. The valve will remain closed at all other times preventing air from entering the interior of the building. The silicone material in the check valve 46 has an inherent resistance to opening the outlet end 54 which must be overcome by the water pressure. It is seen that the use of silicone in the outlet end 54 allows for the end edges 76 and 78 of the walls 74 and 80 to conform to the shape of any foreign material that may have entered the check valve 46 and thereby maintain a seal against incoming air.

The door 14 is moisture protected on the exterior side 20 and at the lower end by the inclusion of moisture resistant material such as cladding 82 on the exterior side 20 which has an inwardly extending portion 84 on the bottom edge 22 which in turn includes an upwardly extending portion 86 received in a groove 87 formed in the wood door 14 as seen in FIG. 2. The bottom edge 22 includes a moisture resistant protective rigid plate 88 having an exterior downwardly extending portion 90 engaging the weatherstripping 36 and an interior downwardly extending flexible portion 92 engaging a wood member 94 in the interior threshold section 26. A bead of sealant 96 is placed in the groove 87.

Figure 8:
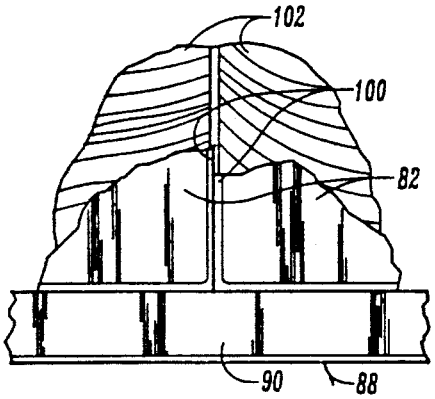
FIG. 8 is a cross-sectional view taken along line 8—8 in FIG. 7.
Figure 7:
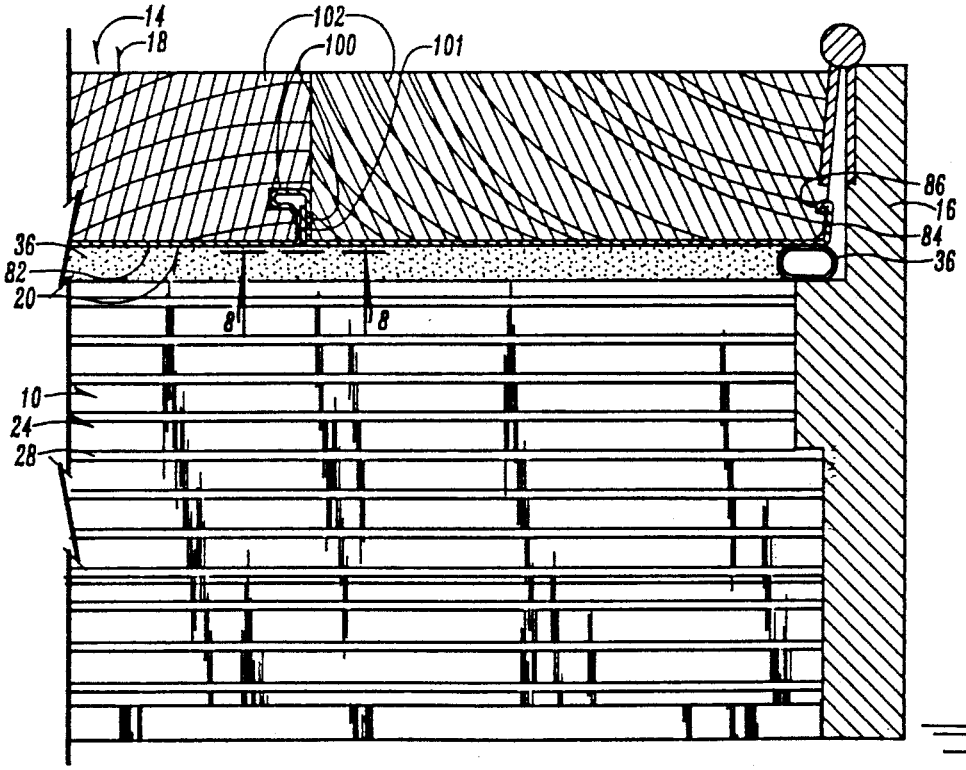
FIG. 7 is a cross-sectional view taken along line 7—7 in FIG. 1.

The cladding 82 as seen in FIGS. 7 and 8 also includes vertically portions 100 received in a groove 101 between abutting panels 102. Moisture entering the vertical groove 101 will run to the bottom of the door and be directed to the outside over the weather seal 36 by the plate 88 and the sealant 96 as seen in FIG. 2. Thus it is seen that the wood of the door 14 is totally sealed against moisture intrusion.

Figure 1:
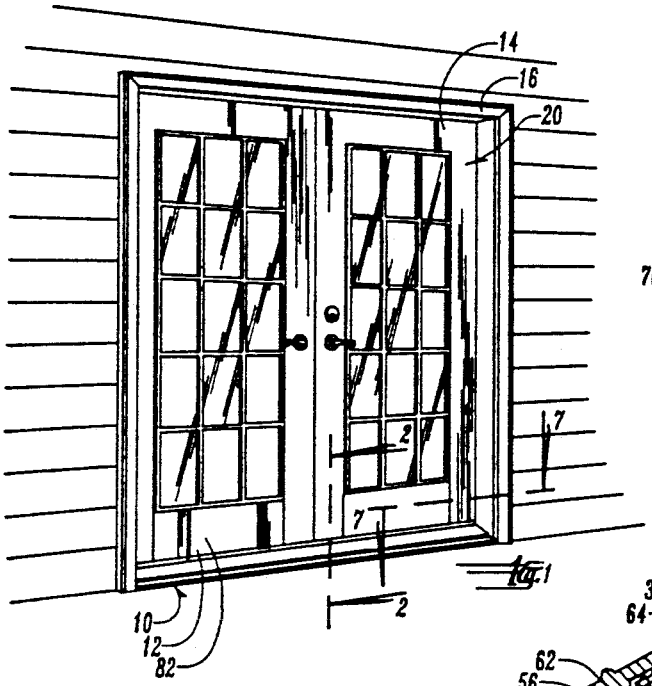
FIG. 1 is an exterior perspective view of french doors utilizing the self draining threshold of this invention.

While an inwardly swinging french door is shown in FIG. 1, the self draining threshold of this invention could be used on sliding doors as well.

I claim:

1. A self draining door threshold comprising, a threshold having a sill, said sill having an exterior section adapted to be positioned on the exterior side of a door and an interior section adapted to be positioned on the interior side of a door, a check valve positioned in said sill and having an inlet side for receiving water from the interior section and an outlet side adapted to open to operatively drain water to the exterior side of a door, and said check valve including a passageway converging from a substantially open end at said inlet side to a substantially normally closed end at said outlet side, said passageway including a flexible side wall in said exterior section which is adapted to be exposed to the exterior air pressure whereby water will flow through said check valve when pressure generated by said water in said passageway exceeds the opposing exterior air pressure combined with pressure required to flex said flexible side wall to open said closed end.

2. The structure of claim 1 wherein water received in said interior section is adapted to be held in a reservoir in communication with said substantially open end of said passageway whereby the pressure generated by water in said reservoir is combined with said pressure generated by said water in said passageway.

3. The structure of claim 2 wherein said passageway is positioned in said exterior section.

4. The structure of claim 3 wherein said reservoir is positioned in said interior section.

5. The structure of claim 4 wherein said interior section includes a removable top wall for providing access to said reservoir.

6. The structure of claim 4 wherein said exterior section includes a removable top wall for providing access to said passageway.

7. The structure of claim 1 wherein said flexible sidewall is made of silicone material.

8. The structure of claim 1 wherein said exterior and interior sections include an inner face which includes a weather strip adapted to engage a door when in a closed position.

9. A self draining door threshold comprising, a door having a door way frame, said door having interior and exterior sides, a threshold having a sill, said sill having an exterior section positioned on the exterior side of the door and an interior section positioned on the interior side of the door, a check valve positioned in said sill and having an inlet side for receiving water from the interior section and an outlet side adapted to open to operatively drain water to the exterior side of said door, and said check valve including a passageway converging from a substantially open end at said inlet side to a substantially normally closed end at said outlet side, said passageway including a flexible sidewall in said exterior section exposed to the exterior air pressure whereby water flows through said check valve when pressure generated by said water in said passageway exceeds the opposing exterior air pressure combined with the pressure required to flex said flexible sidewall to open said closed end.

10. The structure of claim 9 wherein water received in said interior section is adapted to be held in a reservoir in communication with said substantially open end of said passageway whereby the pressure generated by water in said reservoir is combined with said pressure generated by said water in said passageway.

11. The structure of claim 10 wherein said passageway is positioned in said exterior section.

12. The structure of claim 11 wherein said reservoir is positioned in said interior section.

13. The structure of claim 12 wherein said interior section includes a removable top wall for providing access to said reservoir.

14. The structure of claim 12 wherein said exterior section includes a removable top wall for providing access to said passageway.

15. The structure of claim 9 wherein said flexible sidewall is made of silicone material.

16. The structure of claim 9 wherein said exterior and interior sections include an inner face which includes a weather strip adapted to engage said door when in a closed position.

17. The structure of claim 9 wherein said door is moveable between open and closed positions and has top and bottom ends and said sill includes a weather strip operatively engaged by the bottom end of said door when in said closed position.

18. The structure of claim 17 wherein said door is wood and has a bottom edge which includes a moisture resistant plate substantially covering said bottom edge to protect it from moisture.

19. The structure of claim 18 wherein said moisture resistant plate includes a downwardly extending flange on the exterior side of said door engaging said weather strip when said door is in said closed position.

20. The structure of claim 19 wherein said moisture resistant plate includes a downwardly extending weather strip on the interior side of said door engaging said sill when said door is in a closed position.

21. The structure of claim 18 wherein the exterior side of said door includes a moisture resistant plate at said bottom end having a portion which extends along said bottom edge in sealing engagement with said plate on said bottom edge.

22. The structure of claim 21 wherein said portion of said plate on the bottom edge includes an upwardly turned portion received in a groove formed in the bottom edge of said door to seal the bottom edge from moisture.

23. The structure of claim 22 wherein said door includes a plurality of panels in abutting relationship, said moisture resistant plate at said bottom end has inwardly turned portions received in a vertical groove between abutting panels whereby moisture received in said groove is directed outwardly by said moisture resistant plate on said bottom edge.

24. The structure of claim 9 wherein said passageway is wedge shaped and said flexible sidewall is a top wall thereof.

25. A self draining door comprising, a door having oppositely disposed sides and a bottom edge, and including vertically arranged panels in substantial abutting relationship forming a vertical groove therebetween on one of said sides, a plate extending over the bottom edge, and moisture resistant material on said one side of said door having inwardly turned flanges received in said vertical groove between said panels, said groove extending to the bottom edge whereby moisture received in said vertical groove is directed outwardly by said plate on the bottom edge of said door.

26. The structure of claim 25 wherein said plate includes a downwardly extending flange in the plane of said one side of said door adapted to engage weather stripping on a door threshold.

* * * * *